United States Patent [19]

Hanscom

[11] Patent Number: 4,930,293

[45] Date of Patent: Jun. 5, 1990

[54] AUTOMATIC BANDING MACHINE

[75] Inventor: John F. Hanscom, Rehoboth, Mass.

[73] Assignee: H. F. Hanscom & Co., Inc., Providence, R.I.

[21] Appl. No.: 309,117

[22] Filed: Feb. 13, 1989

[51] Int. Cl.[5] ..... B65B 13/14

[52] U.S. Cl. ..... 53/590

[58] Field of Search ..... 53/218, 228, 229, 586, 53/590

[56] References Cited

U.S. PATENT DOCUMENTS

| | | | |
|---|---|---|---|
| 3,000,151 | 9/1961 | Winkler et al. | 53/586 X |
| 3,518,806 | 7/1970 | Davidson et al. | 53/229 X |
| 3,593,490 | 7/1971 | Pinatel | 53/229 X |
| 3,950,203 | 4/1976 | Van der Wal | 53/586 X |
| 3,991,541 | 11/1976 | Eijsermans | 53/586 X |
| 4,041,672 | 8/1977 | Gularte | 53/399 |
| 4,276,736 | 7/1981 | Haberstroh et al. | 53/590 X |
| 4,466,227 | 8/1984 | Hauscom | 53/590 X |

*Primary Examiner*—Robert L. Spruill
*Assistant Examiner*—Linda B. Johnson
*Attorney, Agent, or Firm*—Barlow & Barlow, Ltd.

[57] ABSTRACT

A bander for wrapping a regular or irregular shaped article has gripping jaws that engage the article on a stationary platform. Cohesive/adhesive tape is fed across the platform and into guides at either side of the platform. The guides move upwardly and presser blocks push the tape across the top of the article so that the cohesive/adhesive faces of the tape join.

2 Claims, 2 Drawing Sheets

AUTOMATIC BANDING MACHINE

BACKGROUND OF THE INVENTION

In U.S. Pat. No. 4,466,227, it is suggested to form a banding machine for wrapping tape about an article by placing tape under the article and pushing the tape with folding bars upwardly about the article at which point pincher jaws come across and pinch the band together. Also in the Haberstoh patent, U.S. Pat. No. 4,276,736, a similar arrangement is found where tape from a supply is carried across a platform and guides lift the tape upwardly about the compressed sheets of paper whereupon first one presser comes in from one side and then another from the other side so that the tape is fastened about the article in flat position. There has been in the past some difficulty in operating the prior art devices that principally comes about from the fact that there is no guidance for the tape as it is led up and about the bundle being tied. The result is, since the edges of the tape are not controlled, the manner in which the tape is directed upward can become skewed. There are some applications where it is not permitted for the adhesive material on one side of the tape to be exposed in any fashion whatsoever and this then requires an apparatus where complete control of the tape as it passes upwardly about the article to be banded must be achieved.

SUMMARY OF THE INVENTION

The bander of the present invention overcomes some of the shortcomings noted above and utilizes tape of a pressure-sensitive type which is fed across a platform with the cohesive/adhesive side up through tape guide means on either side of the platform. On either side of the platform there is also pivotally arranged gripping jaws which are actuated to grip the article to be banded. The tape guide means are arranged to be reciprocated upwardly on either side of the platform and the tape placed therein will be pulled out of the tape guides as it proceeds upwardly but will maintain registration therein. Since the tape is tensioned during this operation, it conforms to irregularly shaped bundles. As soon as the tape has been guided upwardly in a proper attitude, presser blocks mounted on the frame that reciprocates the tape guides move inwardly striking the tape and pressing the two ends together and cut off knives then clip the tape evenly. The parts return to normal start position and the cycle can then be repeated.

DESCRIPTION OF THE PREFERRED EMBODIMENT

Figure 1:
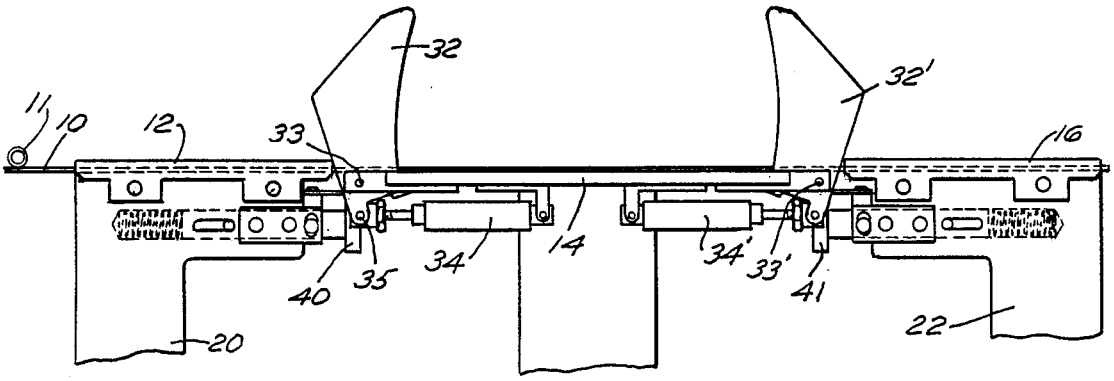
FIG. 1 is a partial elevational view illustrating the banding apparatus constructed in accordance with the present invention.

The drawings in sequence are intended to make clear the general order of the functions of the apparatus and as will be clear from the illustrations, the tape 10 is fed by suitable means 11 such as my previous U.S. Pat. No. 4,466,227, through a first guide 12 and thence across a stationary platform 14 to a second guide 16. As seen in the drawings, the guides 12 and 16 receive the tape and guide at least the edges thereof. Each of the tape guides is mounted on a reciprocating standard, there being a standard 20 with a guide 12 and a standard 22 with a guide 16. These standards, in turn, are mounted on a base assembly 24, both for common vertical movement and for movement toward and away each other by virtue of each being coupled to racks 26, 27 which are coupled together for simultaneous linear motion towards each other and which are actuated by means not shown in the drawing, as for example, a linear actuator coupled as at 29. Vertical movement of the base 24 is provided by a linear actuating cylinder 30.

Figure 2:
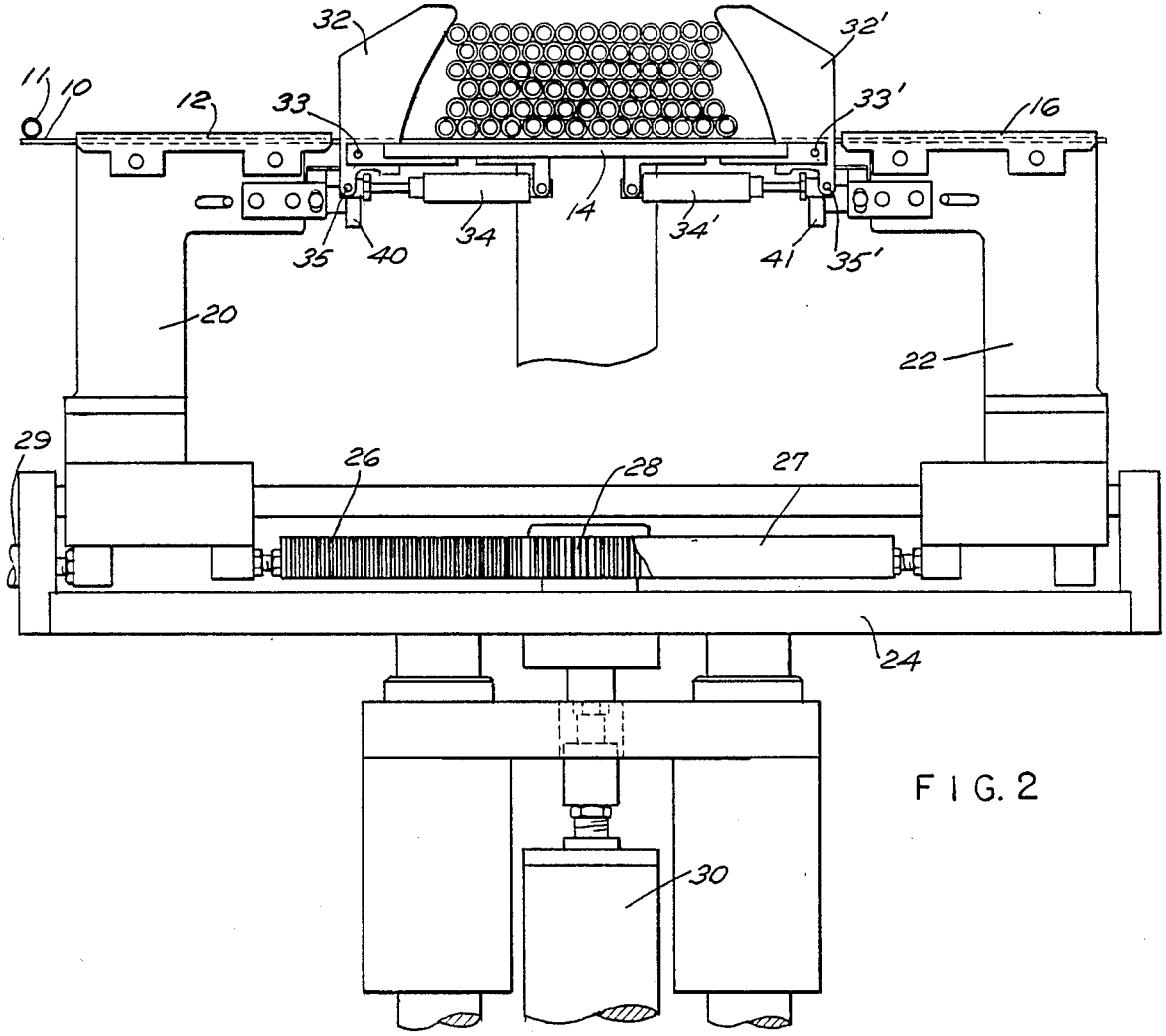
FIG. 2 is a partial elevational view illustrating more of the mechanism for actuating the various parts of the apparatus and illustrating the gripping jaws in gripping position about an article.

When a article is placed on the platform 14, jaws 32, 32' will engage the article. Each of the jaws is pivoted as at 33, 33', respectively, and are rocked into position by air actuators 34, 34' whose actuating rods are coupled as at 35, 35' to the jaws. In the position now as seen in FIG. 2, the tape 10, with its adhesive side up, extends through the tape guides 12 and 16, across the platform 14, upon which the article to be banded is placed. With the actuation of the jaws 32, 32', this now sets into timed sequence the next operation which is seen in FIG. 3.

Figure 3:
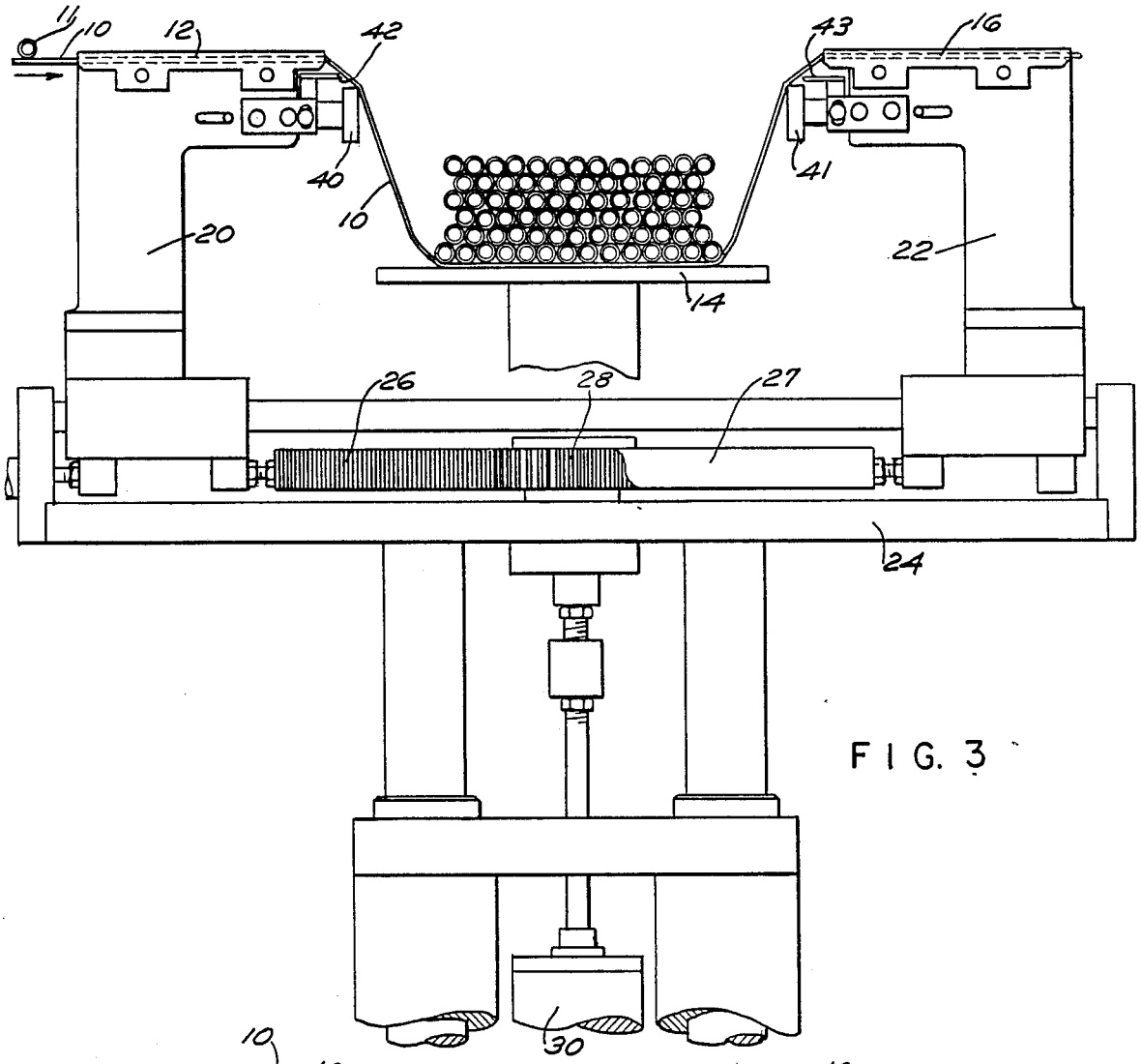
FIG. 3 is a view illustrating the tape being pulled upwardly and out of the tape guides as the tape guides have moved upwardly about the package.
Figure 4:
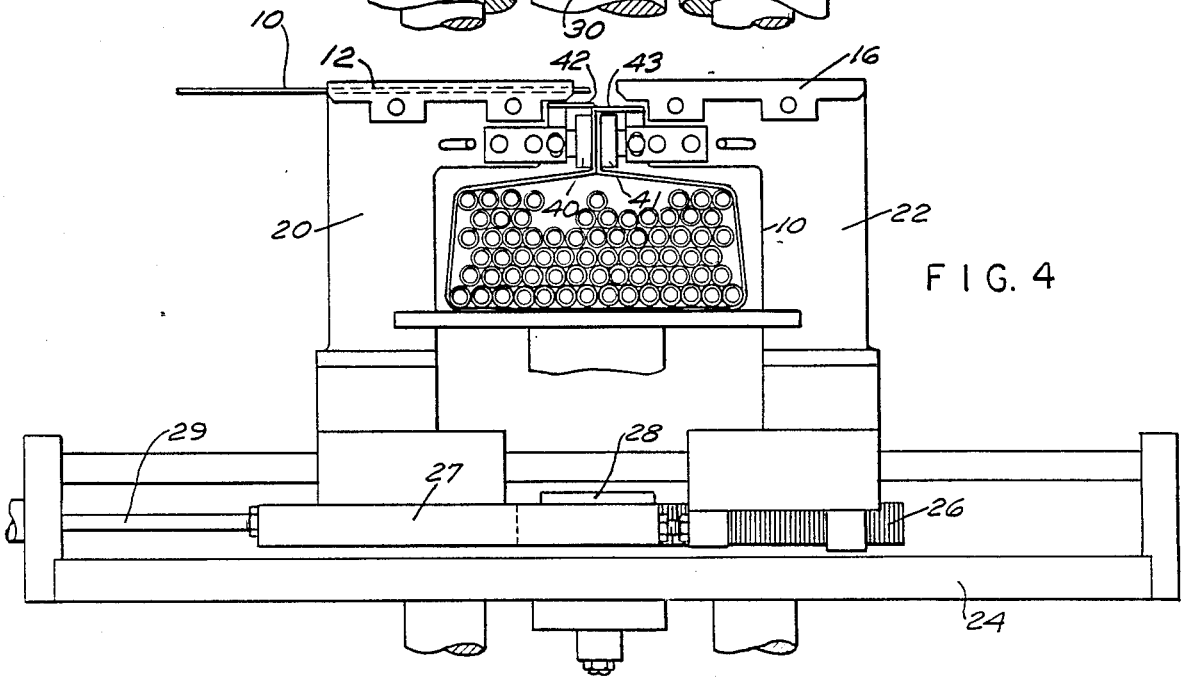
FIG. 4 is a view showing the presser blocks having come together and the cut off knives having engaged the end of the tape.

Referring now to FIG. 3, it will be seen that the actuator 30 has raised the base 24 a finite distance so that the tape 10 is now extending upwardly about the article to be wrapped and has been pulled somewhat from the tape guides 12 and 16. As has been alluded to above, it is important to maintain registration of the tape about the bundle. This is insured by the fact the tape is in the guides 12 and 16. Even irregular bundles can be banded for there exists a natural tension from the path out of the guide and over the blocks 40, 41. The next operation is for actuator 29 to be engaged. Each of the standards 20 and 22 now move inwardly towards each other and while they do, the tape 10 is constantly being pulled out of the tape guides 12 and 16, always remaining in tension and in a registry path. At the end of the stroke, as seen in FIG. 4, the tape has been completely pulled out of the tape guides 12 and 16 and the presser blocks 40 and 41 that are mounted on the standards 20 and 22, respectively, and below the tape guides 12 and 16 have now engaged the tape end portions, pressing them about the article to be wrapped. At the end of the stroke, knives 42, 43 operating in a scissor fashion cut off the end of the tape which is left as a residue and which may be removed by a suction tube (not shown). As an end result, we now have banded a regular or irregular shaped article maintaining the tape in registry all about the article and into a clamped position as seen in FIG. 4.

Having reached the position of FIG. 4, the parts of the apparatus will return to their initial position with the standards 20 and 21 moving outwardly and thence downwardly to datum position and the jaws 32, 32' will open thus permitting ejection of the article that has just been wrapped.

I claim:

1. A bander for wrapping an article comprising (a) a stationary platform for supporting an article to be banded;

(b) a pair of article gripping jaws at opposed edges of the platform, said gripping jaws pivoted adjacent the ends of the platform and normally lying below the level of the platform;

(c) means feeding a length of cohesive/adhesive coated tape adhesive side up across the platform to lie thereon;

(d) a pair of guide means mounted at opposed edges of the platform and coupled together for movement in unison perpendicular to the plane of the platform through which guide means the tape passes and into which the tape is initially retained said guide means engaging at least the edges of the tape;

(e) presser blocks mounted on and below the guide means for movement therewith and parallel to the plane of the platform;

(f) means pivoting said gripping jaws in response to an article being placed on the tape and platform;

(g) means moving the said guide means and presser blocks in a direction substantially normal to said platform whereby the tape held in the guide means is drawn thereout and about the article and said presser blocks press the ends of the tape together at the top end of the upward movement of the guide means.

2. A bander as in claim 1 wherein said presser blocks carry cutter means to sever the tape at a position remote from the package and the said blocks.

* * * * *